United States Patent [19]

Novák et al.

[11] 4,326,966

[45] Apr. 27, 1982

[54] AGENT FOR TEXTILE LIVENING WITH AN ANTISTATIC EFFECT AND FAVORABLE DERMATOLOGIC PROPERTIES

[75] Inventors: Jan Novák; Miloslav Šorm; Karel Ulbert; Stanislav Nešpůrek, all of Prague; Dagmar Mikulcová, Nové Strašeci; Jiří Čmolík, Ústí n/Labem, all of Czechoslovakia

[73] Assignee: Ceskoslovenska akademie ved, Prague, Czechoslovakia

[21] Appl. No.: 158,692

[22] Filed: Jun. 12, 1980

[30] Foreign Application Priority Data

Jun. 20, 1979 [CS] Czechoslovakia ..... 4255-79

[51] Int. Cl.[3] ..... D06M 13/38

[52] U.S. Cl. ..... 252/8.8

[58] Field of Search ..... 252/8.8

[56] References Cited

U.S. PATENT DOCUMENTS

| | | | |
|---|---|---|---|
| 2,205,042 | 6/1940 | Lenher et al. | 252/8.8 |
| 2,596,985 | 5/1952 | Cook et al. | 252/8.8 |
| 2,730,498 | 1/1956 | Fortess et al. | 252/8.8 |
| 2,806,804 | 9/1957 | Davis et al. | 252/8.8 |
| 3,272,712 | 9/1966 | Kalopissis et al. | 424/70 |
| 3,684,567 | 8/1972 | Roth | 252/8.8 |
| 3,697,423 | 10/1972 | Sundy et al. | 252/8.8 |
| 3,729,416 | 4/1973 | Bruning et al. | 252/8.8 |

OTHER PUBLICATIONS

Hawley, *Condensed Chem. Dictionary,* Van Nostrand Co., NY. 1971, pp. 226, 238, 845, 825.

*Primary Examiner*—Maria Parrish Tungol

[57] ABSTRACT

The invention pertains to the textile livening agent with the antistatic effect and favorable dermatologic properties which contains softening, stabilizing, whitening, coloring, scenting and dermatologic components, anionactive, nonionogenic and cationactive tensides and other additives and 2–50 (preferably 4–25) wt. % of 3-(hydroxyalkylamino)-2-hydroxypropyl esters of fatty acids of the general formula $RCOOCH_2CH(OH)CH_2N(R_1R_2)$, where R are the $C_{16}$–$C_{22}$ alkyls or alkenyls, $R_1$ is H, $CH_2CH_2OH$, $CH_2CH_2CH_2OH$, $CH_3CHCH_2OH$, $CH_2CH(OH)CH_3$, $CH_3CH_2CHCH_2OH$, $CH_3CHCH_2CH_2OH$, $CH_2CH_2CH_2CH_2OH$, or $CH_3CHCH(OH)CH_3$, and $R_2$ is the same substituent as $R_1$ except for H. The agent serves for the repeated regeneration of antistatic and other properties of fabrics made of synthetic fibers and is applied to washed and rinsed fabrics by a short-termed soaking, moderate squeeze and drying. The surface electric resistivity of the fabrics is effectively reduced even at the low humidity of environment already by a very small amount of the agent. The said agent is not toxic and its effect is not reduced even by certain amounts of anion-active detergents retained by fabric after incomplete rinsing.

2 Claims, No Drawings

AGENT FOR TEXTILE LIVENING WITH AN ANTISTATIC EFFECT AND FAVORABLE DERMATOLOGIC PROPERTIES

The invention pertains to an agent for textile livening with an antistatic effect and favourable dermatologic properties.

The progress in polymer chemistry and a large choice of polymer compounds available at market considerably influenced development of some industrial branches. Textile industry also belongs to these branches as it used, not long ago, exclusively natural materials, e.g. wool, cotton, silk, flax, etc., in the manufacturing of textile articles. Recently, the textile industry began to utilize plastics, e.g. polyesters, polyamides, polyacrylonitrile, and the like, as raw materials on a large scale, and they entirely replaced natural raw materials in some products, which are becoming still more scarce nowadays. One of the most serious undesirable consequences is the formation of electrostatic charge at the surface of products made of plastics. The electrostatic charge originates by friction, exposure to light, electrolytic processes, piezo-electric and pyrolytic processes, etc. Most of polymeric compounds which are used in textile industry prevent the absorption of water at the surface as well as in the bulk of these materials due to their chemical composition and arrangement of molecules in the polymer chain. Consequently, the products made of plastics absorb only negligible fractions of percent of water if exposed to the effects of moist environment even for longer time and retain the high bulk and surface resistivity ($>10^{13}\Omega$) which assits in the formation and value of surface charge. In return, natural materials, as wool, cotton, etc., adsorb up to 10% of water, depending on the relative humidity of environment, and thus lower their electric resistivity in a natural way and prevent the formation of electrostatic charge. The height of surface charge attains the values as high as several thousands of volts. They cause sparking, sticking of dust and dirt on fabrics, and eventually the formation of large attractive forces between objects placed in the proximity. The effects of surface charges are very unpleasant and in some cases considerably reduce the applicability of plastics in textile industry or the quality of products. Occurence of these charges at the surface of fabrics is undesirable and they need to be removed. Their elimination can be reached in two ways. The first method consists in a permanent bulk antistatic finish of textile products from plastics. An antistatic agent is directly incorporated to the bulk of fabric in the manufacture. This way is in many cases very complicated and often failed. A large amount of antistatic agent must be frequently used which leads to deterioration of mechanic properties and sometimes to the undesirable discolouration of product. The second method employs a short-termed treatment with a surface antistatic agent. The finish consists on soaking of the just washed and rinsed fabric in a solution or emulsion of antistatic agent for a short time, moderate squeeze and drying. Certain disadvantage of this process in comparison with the permanent antistatic finish consists in the necessity to repeat the procedure after each washing, because the antistatic agent is removed by washing from the surface of fabric. However, the advantage of the procedure is that it needs no complex operations, mechanical properties of products remain unchanged, and that the method enables finish of any kind of fabric or article made of plastics even in such case when the permanent finish is impossible.

Most laundry agents still used in practice are based on cationactive tensides containing a quarternary nitrogen atom. Recently also anionactive tensides were tested based on sulfonated and sulfatized salts of polymethacrylates and polyacrylates or on alkylaromatic sulfonated compounds. However, a great number of quarternary ammonium salts are toxic, cause irritation of eyes and exhibit unfavourable dermatologic effects to skin during wearing. Anionactive tensides are hygienically harmless but have a low activity to the fibers made of plastics, i.e. they have a low sorption of fabrics from solution. Efficiency of these antistatic agents is conditioned by application of activating agents.

The object of the invention is the agent for livening of textile with the antistatic effect and favourable dermatologic effects to skin, containing softening, stabilizing, whitening, colouring, scenting and dermatologic additives and optionally, tensides and, further additives commonly used, which contains 2–50 weight percent (preferably 4–25 weight percent) of 3-(hydroxyalkylamino-2-hydroxypropyl esters of fatty acids of the general formula I $$R—COO—CH_2—CH(OH)—CH_2—N(R_1R_2) \qquad I,$$

where

R is an alkyl or alkenyl group with 6–22 carbon atoms in the main chain, $R_1$ is hydrogen, 2-hydroxyethyl, 3-hydroxypropyl, 1-hydroxy-2-propyl, 2-hydroxy-1-propyl, 1-hydroxy-2-butyl, 1-hydroxy-3-butyl, 1-hydroxy-4-butyl, or 2-hydroxy-3-butyl, and $R_2$ is chosen from the same substituents as $R_1$, except for hydrogen.

The remainder to 100% by weight is water.

All unfavourable properties of rinsing agents with the antistatic effect produced till now are removed by application of the present invention, which enables to prepare the agent based on nonionic tensides which contain both a hydrophobic and a hydrophilic part of molecule. These compounds are in their effect comparable to the recently used cationactive tensides, but are not toxic and have favourable dermatologic effects to skin. The compounds applied in the agent with the antistatic effect according to the invention form oriented aggregates which ensure the high efficiency even at a very low concentration of the applied agent. The compound is oriented in such way that the hydrophobic part is attached to a fibre by action of physical forces and the hydrophilic end is directed into outer space. This arrangement facilitates the formation of hydrogen bridges (both intra and intermolecular) which cause the high efficiency of agents also at a relatively low humidity of environment. On the contrary, the cationactive tensides lose much of their efficiency in dry environment. Another advantage of the agent with the antistatic effect according to the invention, in comparison with cationactive tensides, is that it does not react with anionactive detergents used in washing and, consequently, that it does not change the activity if the fabric was not thoroughly rinsed and contained therefore a certain amount of these detergents.

Further effects of the prepared agent, as the easier removing of dirt, softening of fabric, and improved feel, may be achieved by adaptation of the formula or by application of nonionogenic tensides which contain fatty-acid residues of different length in the molecule.

The preparation of variety of agents with the antistatic effect according to this invention is further illustrated in examples of performance which, however, do not limit the scope of invention by any means.

EXAMPLE 1

A kettle was charged with 40 weight parts of water and then 2 weight parts of the reaction product of one molar part of a fatty acid (containing 14–16 carbon atoms) and 5 molar parts of oxirane was gradually added under stirring. Temperature was raised to 40° C. and 7 weight parts of 3-bis(2-hydroxyethyl)amino-2-hydroxypropyl ester of pelargonic acid of formula I [$R=CH_3(CH_2)_7$, $R_1=R_2=CH_2CH_2OH$)] was poured into the reaction mixture. Further were added 51.5 weight parts of cold water and, after homogenization by stirring, 0.3 weight part of a perfume and 0.2 weight part of the solution of food dye. After homogenization, the product was pumped through a filter press into storage tanks and packed. The agent had the antistatic effect expressed by the surface resistivity about $10^9$ ohm per square achieved at the relative humidity of 44% and a softening effect.

EXAMPLE 2

The solution of sodium 2-ethylhexyl sulfosuccinate (21.5 wt. parts) was mixed with 1.5 wt. parts of the 10% aqueous solution of 2-hydroxypropylamide of palm-oil fatty acids and the mixture was heated to 50° C. Then, 15.4 wt. parts of 3-bis(2-hydroxyethyl)amino-2-hydroxypropyl laurate of formula I [$R=CH_3(CH_2)_{10}$, $R_1=R_2=CH_2CH_2OH$], 61.1 wt. parts of cold water, 0.3 wt. part of a parfume and 0.2 wt. part of the solution of food dye were added under stirring. The agent had the antistatic, nonfoaming and softening effects.

EXAMPLE 3

Slovasol 0 (4.6 wt. parts) which is the reaction product of a fatty alcohol containing 14–16 carbon atoms and 5 molar parts of oxirane, was mixed with 15 wt. parts of the 10% aqueous solution of palm-oil fatty acids-isopropanolamides which was heated to 50° C., Then, 11.5 wt. parts of 3-bis(2-hydroxyethyl)amino-2-hydroxypropyl ester of palm-oil fatty acids of formula I [R are $C_5$–$C_{17}$ alkyl, $R_1=R_2=CH_2CH_2OH$], 68.6 wt. parts of cold water and 0.3 wt. part of a parfume are added under stirring. The product was homogenized, pumped through a filter press into a storage tank and packed. It had the antistatic, nonfoaming and softening effects.

EXAMPLE 4

The agent was prepared by the same procedure and from the same amounts of raw materials as in Example 1, with the distinction that 2 wt. parts of the reaction product of nonylphenol with oxirane containing 10 oxyethylene units were added instead of 2 wt. parts of the product from a fatty acid and oxirane. The agent had the antistatic and softening effects.

EXAMPLE 5

The preparation procedure was the same as in Example 1, with the distinction that 6 wt. parts of the 33% aqueous solution of alkylamino betaine AMB-13 and 47.5 wt. parts of cold water were used instead of 2 wt. parts of the product from a fatty acid and oxirane. The product had the antistatic and softening effects.

EXAMPLE 6

The preparation procedure was the same as in Example 1, with the distinction that 3 wt. parts of the 70% aqueous solution of alkylimidazoline as a cationactive tenside and 50.5 wt. parts of cold water were used instead of 2 wt. parts of the product from a fatty acid and oxirane. The agent had the antistatic, dirt repelent and softening effects.

EXAMPLE 7

The preparation procedure was the same as in Example 1, with the distinction that 7 wt. parts of 3-bis(2-hydroxyethyl)amino-2-hydroxypropyl esters of refining acids of formula I [R are $C_{15}$–$C_{17}$ alkyls, $R_1=R_2=CH_2CH_2OH$] were used instead of 7 wt. parts of 3-bis(2-hydroxyethyl)amino-2-hydroxypropyl ester of pelargonic acid.

EXAMPLE 8

The preparation procedure was the same as in Example 1, with the distinction that 7 wt. parts of 3-(2-hydroxyethylamino)-2-hydroxypropyl ester of pelargonic acid of formula I [$R=CH_3(CH_2)_7$, $R_1=H$, $R_2=CH_2CH_2OH$] were used instead of 7 wt. parts of 3-bis(2-hydroxyethyl)amino-2-hydroxypropyl ester of pelargonic acid.

EXAMPLE 9

The preparation procedure was the same as in Example 2, with the distinction that 15.4 wt. parts of 3-(2-hydroxyethylamino)-2-hydroxypropyl laurate of formula I [$R=CH_3(CH_2)_{10}$, $R_1=H$, $R_2=CH_2CH_2OH$] were used instead of 15.4 wt. parts of 3-bis(2-hydroxyethyl)amino-2-hydroxypropyl laurate.

EXAMPLE 10

The preparation procedure was the same as in Example 3, with the distinction that 11.5 wt. parts of 3-(4-hydroxybutylamino)-2-hydroxypropyl laurate of formula I [$R=CH_3(CH_2)_{10}$, $R_1=H$, $R_2=CH_2CH_2CH_2CH_2OH$] were added instead of 11.5 wt. parts of 3-bis(2-hydroxyethyl)amino-2-hydroxypropyl esters of palm-oil fatty acids.

EXAMPLE 11

The preparation procedure was the same as in Example 3, with the distinction that 25 wt. parts of 3-(2-hydroxypropylamino)-2-hydroxypropyl stearate of formula I [$R=CH_3(CH_2)_{16}$, $R_1=H$, $R_2=CH_2CH(OH)CH_3$] were added instead of 11.5 wt. parts of 3-bis(2-hydroxyethyl)amino-2-hydroxypropyl esters of palm-oil fatty acids. The agent had the antistatic and enhanced softening effects.

The antistatic effect of textile livening agent according to the invention was tested by the method of surface resistivity measurements with finished fabrics made of polyester fibers (PES). The fabrics were soaked for 15 minutes at 50° C. in the textile livening agent according to the invention which contained 0.1 wt.% of the effective compound, then they were free dried in air and conditioned for 24 h under the measurement conditions. The surface resistivity was measured by means of terraohmmeter Siemens with electrodes made of conductive rubber. Thus, the livening agent containing the effective compound of formula I based on palm-oil fatty acid esters, where R were $C_5$–$C_{17}$ alkyls and $R_1=R_2=CH_2CH_2OH$, produced the following surface resistivity values of a PES fabric at various relative humidities:

75%—$3.7\times10^9$ ohm/square
66%—$4.1\times10^9$
44%—$4.5\times10^9$
31.9%—$5.5\times10^9$
15%—$1.25\times10^{10}$.

The surface resistivity of the untreated PES fabric was higher than $5\times10^{12}$ ohm/square at the relative humidity of 60%.

We claim:

1. The textile livening agent with the antistatic effect and favourable dermatologic properties containing at least one additive selected from the group consisting of softening stabilizing, whitening, colouring, scenting and dermatologic additives and tensides and wherein the said agent contains 2–50 weight percent of 3-(hydroxyalkylamino)-2-hydroxypropyl esters of fatty acids of the general formula I $$R—COO—CH_2—CH(OH)—CH_2—N(R_1R_2), \quad I$$

where

R represents an alkyl or alkenyl group with 6–22 carbon atoms in the main chain, $R_1$ is hydrogen, 2-hydroxyethyl, 3-hydroxypropyl, 1-hydroxy-2-propyl, 2-hydroxy-1-propyl, 1-hydroxy-2-butyl, 1-hydroxy-4-butyl, 1-hydroxy-3-butyl, or 2-hydroxy-3-butyl, and $R_2$ represents the same substituent as $R_1$, except for hydrogen the remainder to 100% by weight being water.

2. The textile livening agent of claim 1, wherein said agent contains 4–25 weight percent of said esters of the general formula I.

* * * * *